US005502451A

United States Patent [19]

Rainville et al.

[11] Patent Number: 5,502,451

[45] Date of Patent: Mar. 26, 1996

[54] PATCH ANTENNA WITH MAGNETICALLY CONTROLLABLE RADIATION POLARIZATION

[75] Inventors: Peter J. Rainville, Stow, Mass.; Frances J. Harackiewicz, Carbondale, Ill.

[73] Assignee: The United States of America as represented by the Secretary of the Air Force, Washington, D.C.

[21] Appl. No.: 284,884

[22] Filed: Jul. 29, 1994

[51] Int. Cl.$^6$ ..... H01Q 1/38

[52] U.S. Cl. ..... 343/700 MS; 343/787; 333/21 A

[58] Field of Search ..... 343/787, 700 MS, 343/788, 756; 333/21 A, 24.3; H01Q 1/38, 1/00

[56] References Cited

U.S. PATENT DOCUMENTS

| | | | |
|---|---|---|---|
| 3,653,054 | 3/1972 | Wen | 343/787 |
| 3,811,128 | 5/1974 | Munson | 343/787 |
| 4,660,048 | 4/1987 | Doyle | 343/700 MS |
| 4,780,724 | 10/1988 | Sharma et al. | 343/700 MS |
| 4,783,661 | 11/1988 | Smith | 343/700 MS |
| 4,821,041 | 4/1989 | Evans | 343/700 MS |
| 4,879,562 | 11/1989 | Stern et al. | 343/700 MS |
| 4,985,709 | 1/1991 | Nishikawa et al. | 343/787 |
| 5,229,777 | 7/1993 | Doyle | 343/700 MS |
| 5,327,148 | 7/1994 | How et al. | 343/700 MS |

*Primary Examiner*—Donald T. Hajec
*Assistant Examiner*—Tan Ho
*Attorney, Agent, or Firm*—William G. Auton

[57] ABSTRACT

A microstrip patch antenna with radiation polarization that can be magnetically varied via the application of the in-plane magnetic field. The antenna comprises a retangular metallic patch which is deposited on a ferrite film, which itself has been deposisted on a dielectric substrate. The patch is fed via an SMA connector which is grounded to the back of the substrate. The center pin of the connector passes through a hole drilled in the substrate. The patch radiates first and second perpendicular polarizations. The first polarization is broadband in frequency, and does not tune with an applied magnetic field. The second polarization is narrowband in frequency, and its center frequency increases as an in-plane bias field is applied. As bias is applied, the narrowband radiation tunes across the frequency bandwidth of the more broadband, perpendicularly polarized radiation. The phase relationship between the two polarizations is thus changed at frequencies at which power is radiated by both polarizations.

3 Claims, 2 Drawing Sheets

FIG. 1
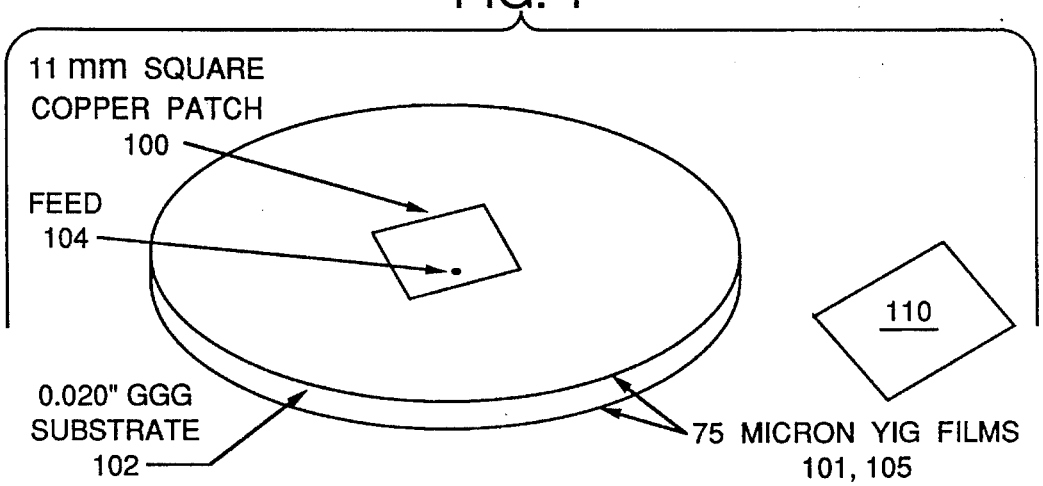
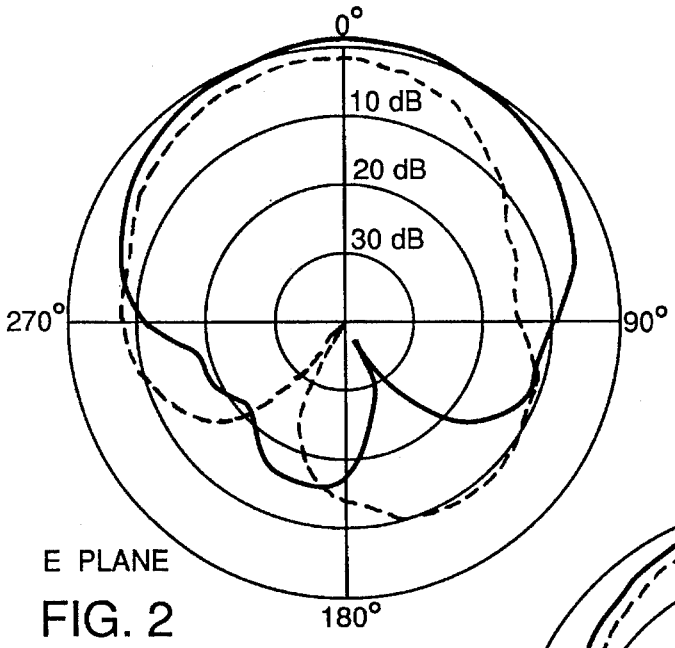
FIG. 2
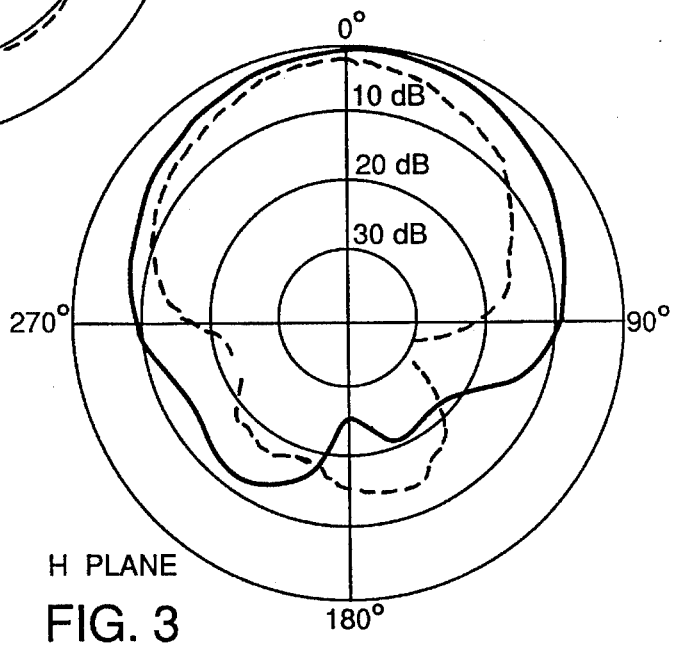
FIG. 3

PATCH ANTENNA WITH MAGNETICALLY CONTROLLABLE RADIATION POLARIZATION

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to antennas, and more specifically the invention pertains to a microstrip patch antenna for radiating an electromagnetic signal with a polarization that is magnetically varied by an application of an in-plane magnetic field.

The term "polarization" refers to the process of making light or other radiation vibrate perpendicular to the ray. The vibrations are straight lines, circles or ellipses—giving plane, circular, or elliptical polarization, respectively.

The direction of polarization of an antenna is defined as the direction of the electric field vector. Most radar antennas are linearly polarized; that is, the direction of the electric field vector is either vertical or horizontal. The polarization may also be elliptical or circular. Elliptical polarization may be considered as the combination of two linearly polarized waves of the same frequency, traveling in the same direction, which are perpendicular to each other in space. The relative amplitudes of the two waves and the phase relationship between them can assume any values. If the amplitudes of the two waves are equal, and if they are 90° out of (time) phase, the polarization is circular. Circular polarization and linear polarization are special cases of elliptical polarization.

Existing microstrip patch antennas are typically fabricated on dielectric substrates only, are very narrowband and radiate linear or circular polarization only, and are not frequency tunable. Achieving circular polarization requires an offset feed, or two separate feeds and a signal splitting network to provide the proper phase and magnitude signals to the feeds.

Investigations have been made of patch antennas fabricated on bulk ferrite substrates, and frequency tuning of a linearly polarized antenna, via the application of an in-plane magnetic field, has been demonstrated. The invention differs from previous work in that it does not require a ferrite substrate, but just a thin ferrite film and a dielectric substrate, and it radiates two orthogonal polarizations, and the phase relationship between these polarizations is varied by the application of an in-plane magnetic field. The task of providing a microstrip patch radiating element whose radiation polarization can be varied via the application of an in-plane magnetic field is alleviated to some extent by the system described in the following U.S. Patents, the disclosures of which are incorporated herein by reference.

U.S. Pat. No. 4,879,562 issued to Stem et al;

U.S. Pat. No. 4,821,041 issued to Evans;

U.S. Pat. No. 4,783,661 issued to Smith;

U.S. Pat. No. 4,780,724 issued to Sharma et al;

U.S. Pat. No. 4,660,048 issued to Doyle and

U.S. Pat. No. 3,811,128 issued to Munson.

The patents identified above, relate to various patch antenna designs. In particular, the Evans patent describes a microwave patch antenna which comprises a substrate of high dielectric constant, an aperture in the substrate and a patch conductor. The patch conductor is positioned on one major surface of the substrate and juxtaposed over the aperture. A ground plane is positioned on another surface of the substrate, and has an aperture juxtaposed to at least a substantial proportion of the patch conductor. A conductive cavity is RF-coupled to the ground plane at the aperture, and the length of the cavity is adjustable to tune the antenna.

The Smith patent is directed to a circularly polarized antenna which comprises first and second multiple patch antenna structures dimensioned to operate at two distinct frequencies. Each antenna structure consists of four shorted patches. The patches of the first structure are spaced from a ground plane by dielectric material, as are the patches of the second structure spaced from the patches of the first structure. The patches of both structures are disposed in the planes of the patches so that the radiation edges of the two patch structures form superimposed antenna structures.

The Sharma et al patent relates to a patch antenna with an internal tuning element. The patch antenna is formed on one broad surface of a semiconductor plate, and a ground plane is formed on a second broad surface. The semiconductor is doped in regions near a periphery of the patch to define a semiconductor junction. The junction has capacitance which tunes the patch antenna. The characteristics of the junction are controlled by bias to selectively tune the patch antenna.

The Doyle patent describes a microstrip patch antenna comprised of either a single element or a plurality of stacked antenna elements. The stacked elements have one or more feedpins connected to a corresponding number of conductive elements which are capacitively coupled to the antenna elements. The feedpins have an inductive reactance which is cancelled by trimmed flags to provide the capacitance necessary to cancel the inductance for tuning the antenna. Although these patents relate to various designs for patch antennas, they do not describe a patch antenna with radiation polarization that can be magnetically varied by the application of an in-plane magnetic field.

SUMMARY OF THE INVENTION

Broadly the present invention includes a microstrip patch antenna application of an in-plane magnetic field. The antenna has a reatangular metallic patch which is deposited on a ferrite film, which itself has been deposited on a dielectric substrate. The patch is fed via an SMA connector which is grounded to the back of the substrate. The center pin of the connector passes through a hole drilled in the substrate. The patch radiates first and second perpendicular polarizations. The first polarization is broadband in frequency, and does not tune with an applied magnetic field. The second polarization is narrowband in frequency, and its center frequency increases as an in-plane bias field is applied. As bias is applied, the narrowband radiation tunes across the frequency bandwidth of the more broadband, perpendicularly polarized radiation. The phase relationship between the two polarizations is thus changed at frequencies at which power is radiated by both polarizations.

It is an object of the invention to magnetically vary the polarization of patch antennas.

It is another object of the invention to provide a circularly-polarized radiating element whose operating frequency may be magnetically varied.

These objects together with other objects, features and advantages of the invention will become more readily apparent from the following detailed description when taken in conjunction with the accompanying drawings wherein like elements are given like reference numerals throughout.

DESCRIPTION OF THE DRAWINGS

FIG. 1 is an illustration of the preferred embodiment of the present invention;

FIGS. 2 and 3 are charts depicting E-plane and H-plane radiation patterns, at 5.95 GHz, for unbiased patch, and indicating strong co-polarised and cross-polarised radiation.

DETAILED DESCRIPTION OF THE PREFERRED EMBODIMENT

Figure 4:
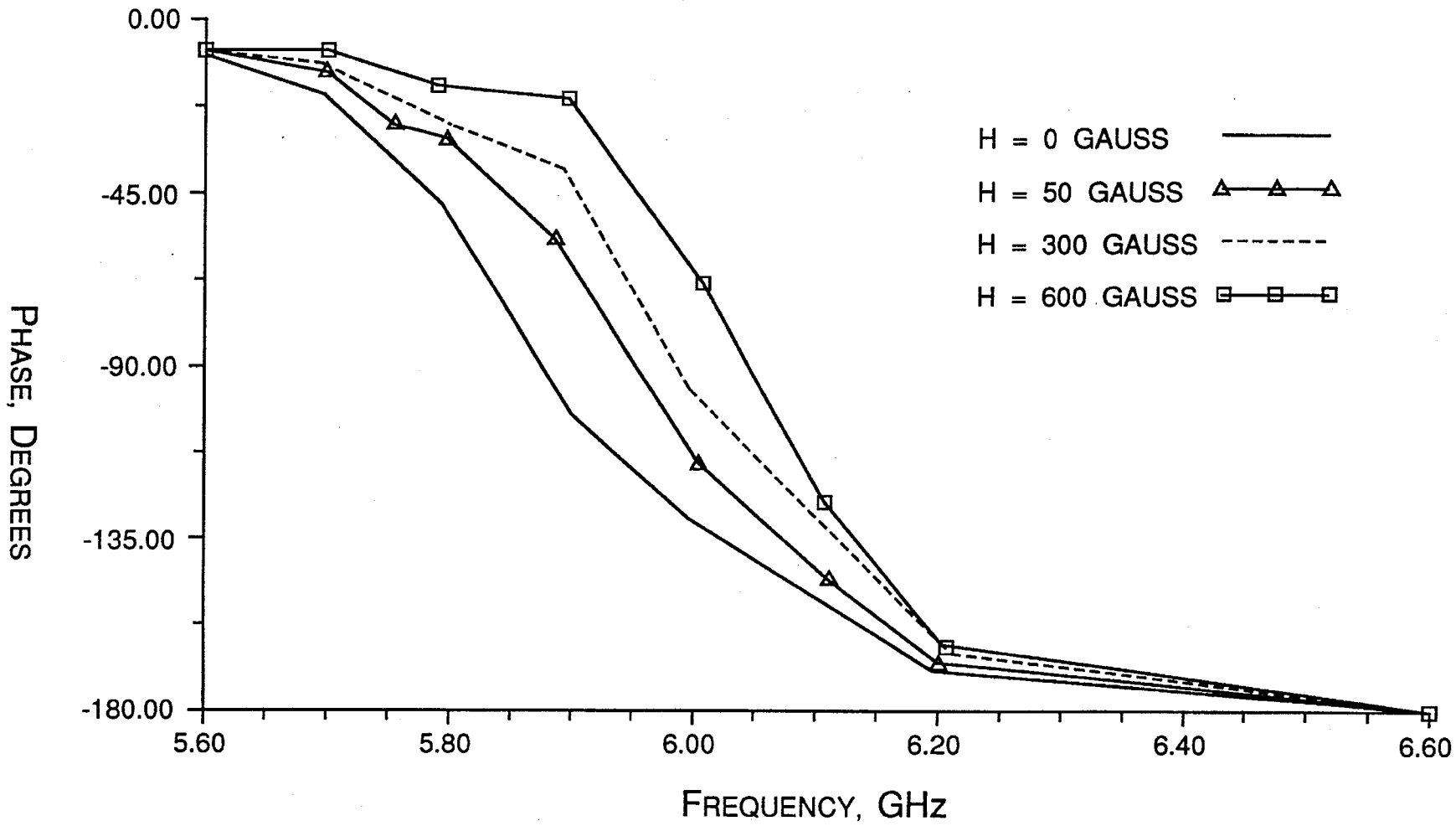
FIG. 4 is a chart of the phase difference between cross-polarized and co-polarized radiated fields, at broadside, as a function of frequency and magnetic bias in the y direction.

The present invention includes a microstrip patch antenna whose radiation polarization can be magnetically varied via the application of an in-plane magnetic field. A second use as a circularly-polarized antenna whose frequency of operation can be tuned by an applied magnetic field is also possible. The patch is retangular and is deposited on a ferrite film (Yttrium Iron Garnet), which has itself been deposited, via LPE, on a GGG (Gadolinium Gallium Garnet) wafer (a standard commercial procedure). The backside of the GGG substrate is also metallized. The patch is fed centered along and very near one of its edges, and radiates well formed co-polarized and cross-polarized field patterns. The frequency bandwidth of the co-polarized radiation is several times larger than that of the cross-polarized radiation. However the application of a modest dc magnetic field (less than 500 gauss) in the plane of the film tunes the radiation frequency of the cross-polarized radiation only. The frequency at which the two polarizations are 90 degrees out of phase, corresponding to circular polarization, tunes with the magnetic field, while at the frequency at which the polarizations were originally 90 degrees out of phase with no applied field, the relative phase difference can be reduced to nearly zero, and the polarization becomes nearly linear.

The reader's attention is now directed towards FIG. 1, which is an illustration of an embodiment of the invention In FIG. 1, a square metallic patch 100, in this case 11 mm on a side, is deposited onto a ferrite film 101, which has itself been deposited on a dielectric substrate 102. The backside of the dielectric substrate is also metallized. Standard deposition and photolithographic techniques may be used to deposit the patch and define the patch and backside metallization. The patch is fed via an SMA connector 104 which is grounded to the back of the substrate. The center pin of the connector passes through a hole drilled in the substrate and centered along one of the sides of the patch, and slightly inset from the edge. (other types of feeds, such as a microstrip feed on the top surface of the substrate, would probably also work). The feed is located on the patch so as to excite one mode of the patch only, assuming that the ferrite film was not present.

Experimentally, it was determined that the patch radiates two perpendicular polarizations, one rather broadband in frequency, and that does not tune with an applied magnetic field, and another, rather narrowband in frequency, and the center frequency of which increases as the in-plane bias field is applied. Resonant structures, such as the patch antenna, exhibit large changes near the resonant frequency in the phase of a transmitted or reflected signal. As bias is applied, the narrowband radiation tunes across the frequency bandwidth of the more broadband, perpendicularly polarized radiation. Thus the phase relationship between the two polarizations is changed at frequencies at which power is radiated by both polarizations. This is the reason that the overall polarization of the antenna can be varied—when the two polarizations are in phase, the overall polarization of the antenna is linear; when they are 90 degrees out of phase, it is nearly circular. The purpose of the ferrite film is to create the tunable, more narrowband polarization; the purpose of the dielectric substrate is to create the broadband polarization that does not tune with the bias field.

The ferrite coated wafer (YIG-GGG-YIG) is available commercially. YIG was present on both sides of the GGG substrate but it is only the ferrite under the patch that is believed to affect the antenna's operation. An in-plane magnetic field must be applied to the patch for it to function as described. Although external electromagnets 110 are used to provide a variable magnetic field, an on-wafer magnetic bias circuit may be feasible, using deposited thin film magnets, is understood to be within the scope of this invention.

FIGS. 2 and 3 are charts of E-plane and H-plane radiation patterns at 5.95 GHz for the patch of FIG. 1. These figures depict the strong co-polarized and cross-polarized radiation.

Existing microstrip patch antennas are narrowband and designed to radiate one polarization only. The invention is more versatile in that the radiation polarization can be varied via the application of an in-plane magnetic field. For satellite communications, a circularly-polarized antenna is necessary because of Faraday rotation of radiation polarization of radio-wave transmission through the atmosphere; however for terrestrial communications linear polarization may be optimal. The invention could satisfy both requirements with one antenna. Conventional patch antennas are not used if more than a few percent frequency bandwidth is required. However, for many applications, such as frequency-agile radar or radio, a tunable antenna can be used instead of a broadband antenna. The invention could be useful as a substitute for a broadband antenna in some applications, as an alternate use of the invention may be as a frequency-tunable circularly polarized antenna.

The invention simply requires a thin ferrite film (on the order of microns thick) on top of the dielectric, as opposed to other tunable patch antennas which have been fabricated on bulk ferrite substrates (on the order of hundreds of microns thick). The use of film rather than bulk ferrite substrates makes the invention much more capable of monolithic integration with semiconductors, due to recent progress in the deposition of ferrite films onto a semiconducting substrate such as GaAs. The invention is thus much more MMIC (Monolithic microwave Integrated Circuit) compatible than a tunable antenna fabricated on a ferrite substrate—an important advantage given the current thrust towards fully monolithic systems. Also, the use of in-plane magnetic fields, as opposed to a magnetic field normal to the ferrite material, which have been used on some patch antennas fabricated on bulk ferrites substrates, is significant. Considerable progress has been made over the last few years in the deposition and optimization of thin-film permanent magnets. These magnets could be used in an MMIC to provide an in-plane bias field, but, due to the high-demagnetization factor of the thin films, probably could not produce much field strength perpendicular to the plane of the magnetic film. Therefore, a device which uses in-plane magnetic bias field is much more likely to be monolithically integrable in any completely self-contained (i.e.—no electromagnet outside of the circuit) future designs than one requiring a bias field normal to the plane of the device.

The patch has been discussed as a single element, however to achieve higher gain, several patch elements are usually combined into phased arrays. The use of several antennas as a tunable phased array would be an alternative and desirable implementation of the invention. Typically, numerical calculations are done on the computer to design and predict the exact behavior of phased array antennas.

Patch antennas are widely used because they are lightweight, conformal and easy to manufacture. Their principal disadvantage—narrow instantaneous bandwidth—has led to the investigation of the incorporation of ferrites with patches to obtain magnetic tuning of the radiation frequency of the patch. We describe a square, single-feed patch, fabricated on a ferrite film, that produced orthogonally polarized, well-formed radiation patterns. The application of a small in-plane magnetic field tuned the frequency, and hence phase, of one polarization only. Prior work on patch antennas fabricated on bulk ferrite substrates demonstrated magnetic tuning, but only linear polarization was obtained. The present work indicates that 1) thin ferrite films, which are monolithically integrable, may be useful for a magnetically-tunable antenna, and 2) the radiation polarization of the patch can be varied by the application of a small in-plane magnetic bias field.

As mentioned above, FIG. 1 illustrates the patch and the coordinate system. The patch is fabricated on a YIG (Yttrium Iron Garnet) film, which itself is deposited on both sides of a GGG (Gadolinium Gallium Garnet) wafer. The YIG-GGG-YIG substrate is manufactured by Litton-Airtron and has 75 micron thick Gallium-doped YIG films (saturation magnetization=1250 Gauss) on both sides of the 0.5 mm thick GGG substrate (dielectric constant=13). The patch measures 11 mm on a side and is fed through the ground plane by an SMA connector, the center pin of which passes through a hole drilled in the substrate. The x-direction is referred to as co-polarized direction, (and the y-direction as cross-polarized) because a patch fabricated on a dielectric substrate and fed as indicated in FIG. 1 would have its radiation polarization predominantly in the x-direction. E-plane and H-plane antenna patterns of the patch, taken at a frequency of 5.95 GHz and zero magnetic bias, are shown in FIG. 2. Data for the unbiased patch, and for the magnetic tuning of the cross-polarized component as a function of y-directed bias, are summarized in Table 1. To obtain the data for Table 1 (and FIG. 3), the patch was placed in an electromagnet, and, using an open waveguide, the phase and magnitude of the co-polarized and cross-polarized radiated fields measured at a point broadside to the antenna. The magnetic field was increased to a large value (600 Gauss), and then data taken as the field is decreased. Zero-magnetic bias data were measured in an anechoic chamber.

Referring to Table 1, the co-polarized radiation has a considerably larger frequency bandwidth than that of the cross-polarized radiation, and does not tune with either x-directed or y-directed bias. The cross-polarized component has a lower resonance frequency than the co-polarized field, and tunes up in frequency for a y-directed magnetic field, but does not appear to tune with an x-directed magnetic field. Beyond 600 Gauss, little tuning effect was observed. The return loss from the input probe of the patch was usually less than −10 dB.

TABLE 1

Zero-bias characteristics of patch and magnetic tuning of cross-polarized radiation component for y-directed magnetic bias. Data obtained by a transmission (S21) measurement, sampling the radiated fields at a point broadside to the patch antenna.

| Zero-bias: | Center Frequency (GHz) | Bandwidth (3dB) |
|---|---|---|
| Co-pol | 5.975 | 760 Mhz |
| Cross-pol | 5.75 | 275 MHz |
| **Y-directed bias:** | **Center Frequency (GHz)** | **H Applied (Gauss)** |
| Co-pol | no tuning | no tuning |
| Cross-pol | 6.03 | 600 |
| | 5.97 | 300 |
| | 5.93 | 50 |
| | 5.86 | 7 |

Resonant structures, such as the patch antenna, exhibit large changes in the phase of a transmitted or reflected signal as the frequency is tuned through resonance. Only one polarization is tuned in frequency by the bias field. Because the non-tuned polarization has a relatively larger frequency bandwidth, the phase relationship between the two polarizations is changed at frequencies for which power is radiated by both polarizations. As bias is applied in the y-direction, the cross-polarization resonant frequency increases, and sweeps across the lower part of the co-polarized frequency bandwidth. FIG. 4 is a plot of the phase of the cross-polarized field relative to the co-polarized field, at broadside, as a function of frequency and magnetic bias in the y-direction. At zero bias, the two field components are 90 degrees out of phase at approximately 5.84 GHz. At 600 Gauss applied field, the frequency at which they are 90 degrees out of phase has shifted to approximately 6.025 GHz, and at 5.84 GHz the phase difference has been reduced to 20 degrees. The frequency at which the antenna radiates maximum power is very close to the frequency at which the two polarizations have a 90 degree phase difference, but the radiation at 5.84 GHz and 600 Gauss (phase difference of 20 degrees) is within the 3 dB bandwidth of both polarizations.

Neither the radiation at 5.84 GHz and zero bias nor that at 6.025 GHz and a bias of 600 Gauss is circularly polarized because, though not plotted, there is as much as a 3 dB difference in the magnitudes of the components. Also, the minimum phase difference observed (5.84 GHz and 600 Gauss) was 20 degrees, not zero, and linear polarization requires zero phase difference between polarizations (or a considerable reduction of the power radiated by one of the polarizations). Thus the antenna described here does not produce perfect linear or circular polarization; however, it does demonstrate the basic behavior required of such an antenna, via the application of an in-plane bias field. Many variables are available for optimization of the present antenna, such as ferrite film and dielectric thickness. RF feed location, and the dimensions of the patch.

YIG films were used in this experiment because they are single crystal, and have considerably lower magnetic linewidths (on the order of 1 Oersted) than polycrystalline substrates (on the order of tens of Oersteds). Also, there is much interest in integrated microwave devices and antennas, and recently considerable progress has been made towards monolithically incorporating ferrite films and semiconductors [7,8]. Integration of a tunable antenna that used the properties of a bulk ferrite substrate into a completely monolithic microwave system would be difficult, as it would require the development of the technology to deposit high quality semiconductors onto the ferrite (or vice-versa).

A single-feed, square microstrip patch antenna, fabricated on a ferrite film on a dielectric substrate, has been shown to radiate both cross-polarized and co-polarized fields, of nearly equal maximum magnitude, with well-formed antenna patterns for each polarization. The application of an in-plane magnetic bias field tunes the resonant frequency of the cross-polarized field, but not the co-polarized field, indicating that a monolithically integrable patch antenna which is circularly polarized and whose operating frequency may be magnetically tuned, or whose radiation polarization, at a single-frequency, may be magnetically tuned from circular to linear, is possible. The result is very different from a similar work done on a patch on a bulk ferrite substrate, in which the co-polarized component, rather than the cross-polarized component, tuned with an in-plane magnetic field, and though the cross-polarization level was high, the pattern was not well-formed or usable.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A microstrip patch antenna which radiates an electromagnetic signal which has a variable polarization, said microstrip patch antenna comprising:

a substrate;

a ferrite film on top of said substrate;

a microstrip patch placed on top of said ferrite substrate;

a feed which is placed on the edge of said microstrip patch to conduct said electromagnetic signal thereto and cause said microstrip patch to radiate said electromagnetic signal thereby; and a means for applying a magnetic field to said microstrip patch to vary thereby the variable polarization of the electromagnetic signal, wherein said applying means comprises an external electromagnet which is fixed in proximity with said microstrip patch to emit a d.c. magnetic field thereon, said d.c. magnetic field having a strength of up to 500 gauss.

2. A microstrip patch antenna, as defined in claim 1, wherein said microstrip patch is a square copper layer of metal deposited upon said ferrite film.

3. A microstrip patch antenna, as defined in claim 1, wherein said substrate comprises a Gadolinium Gallium Garnet wafer.

* * * * *